US005239146A

United States Patent [19]

Blubaugh

[11] Patent Number: 5,239,146

[45] **Date of Patent: * Aug. 24, 1993**

[54] SAFETY ACTUATOR APPARATUS FOR ONE-PIECE OVERHEAD GARAGE DOOR OPERATOR

[75] Inventor: Terry L. Blubaugh, Diamond Bar, Calif.

[73] Assignee: Holmes-Hally Industries, Los Angeles, Calif.

[ * ] Notice: The portion of the term of this patent subsequent to Oct. 20, 2009 has been disclaimed.

[21] Appl. No.: 918,834

[22] Filed: Jul. 23, 1992

Related U.S. Application Data

[63] Continuation-in-part of Ser. No. 667,807, Mar. 11, 1991, Pat. No. 5,157,230.

[51] Int. Cl.[5] ..... H01H 3/16; E05F 15/02

[52] U.S. Cl. ..... 200/61.43; 49/26

[58] Field of Search ..... 200/61.43, 511; 49/26, 49/27, 28; 174/35 GC

[56] References Cited

U.S. PATENT DOCUMENTS 3,118,984 1/1964 Koenig ..... 200/61.43

5,157,230 10/1992 Blubaugh ..... 200/61.43

*Primary Examiner*—J. R. Scott

*Attorney, Agent, or Firm*—Fulwider, Patton, Lee & Utecht

[57] ABSTRACT

An elongated, electrically conductive, inwardly protruding hollow channel defining an interior chamber is mounted to the lower edge of a one-piece garage door. Mounted within the chamber is a contact strip extending longitudinally along the channel and disposed below the center line thereof such that deflection interiorly of the wall of the channel upon contact with an obstructing object will cause it to engage the contact strip. The channel is optionally mounted to a base perpendicularly extending away from the plane of the door to provide early warning of a contact with an obstructing object.

8 Claims, 3 Drawing Sheets

FIG. 1
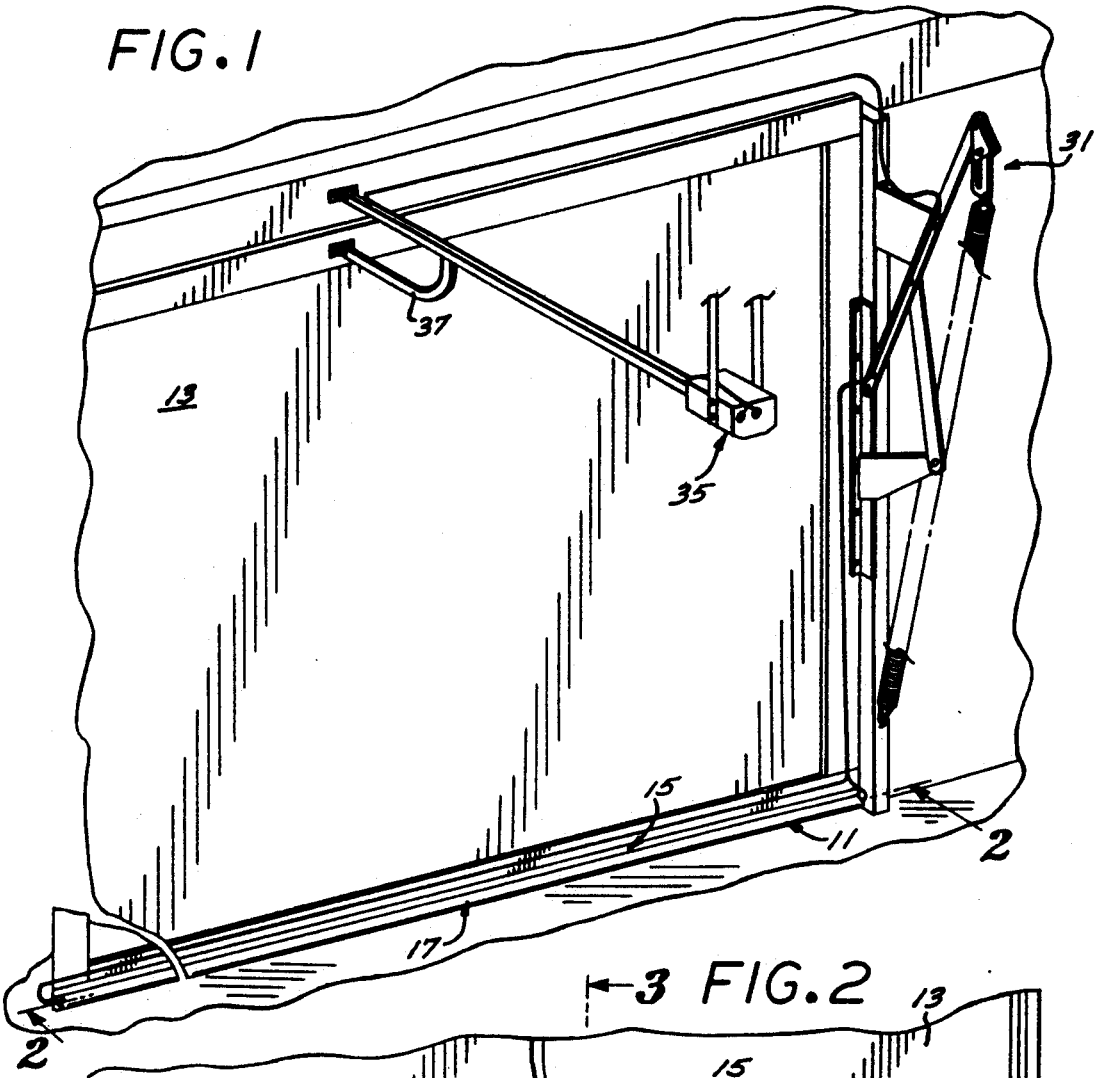
FIG. 2
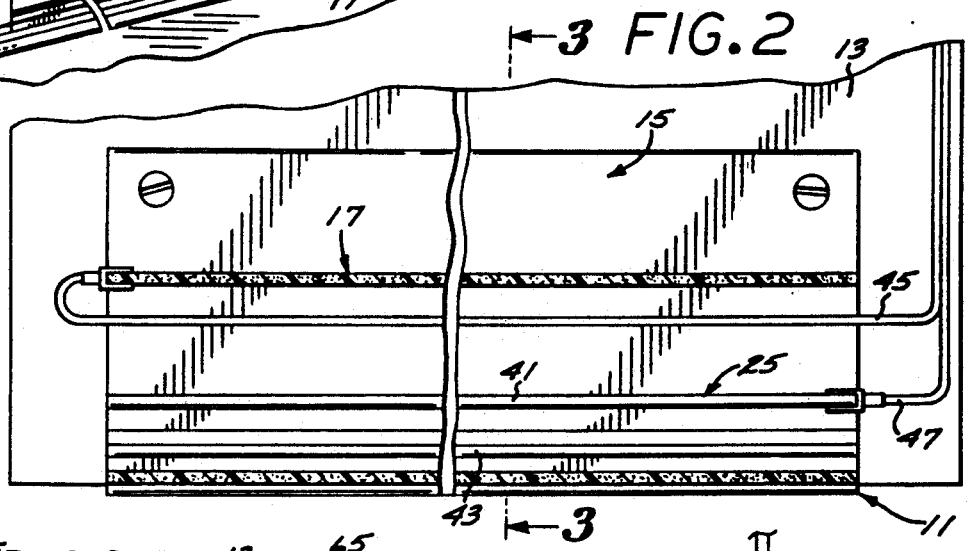
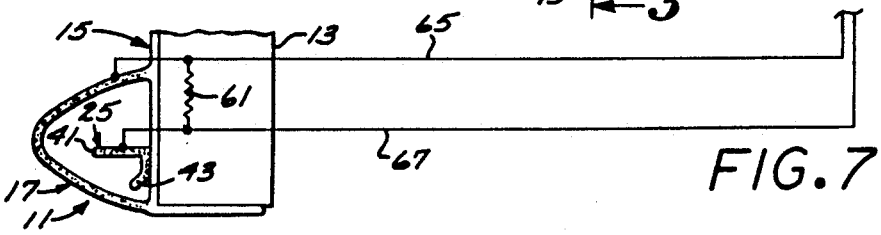
FIG. 7

SAFETY ACTUATOR APPARATUS FOR ONE-PIECE OVERHEAD GARAGE DOOR OPERATOR

This is a continuation-in-part of U.S. patent application Ser. No. 07/667,807, filed on Mar. 11, 1991 and is now U.S. Pat. No. 5,157,230.

BACKGROUND OF THE INVENTION

1. Field of the Invention

The present invention relates to a safety device for mounting on an automatically operated garage door which is responsive to engagement with an obstructing object to halt and reverse an operator.

2. Description of the Prior Art

The advent of automatic doors actuated by automatic operators has led to the need for pressure sensitive deactuation devices which are responsive to contact with an object located in the door path to deactuate the operator. A number of injuries, and even deaths, have been reported due to the lack of a effective safety actuator for stopping or reversing an automatic operator upon the door making contact with a hapless person passing through the path thereof.

Current popularity of overhead garage doors driven by an automatic operator for opening and closing have led to further development of various sensing devices. Many such automatic closures incorporate a pressure sensing arrangement along the lower edge of the door such that upon contact with a vehicle or the like will deactuate the operator to minimize damage to the vehicle or door structure. However, such devices typically suffer the shortcoming that the deactuating devices require application of significant amounts of force thus resulting in the impact of damaging or injuring forces to the obstructing object before the deactuator becomes fully operative.

U.S. Pat. No. 3,001,038 to Gazelle recognized the existence of a need for an automatic deactuator highly responsive to the encountering of an obstruction to halt closure. However, the relatively sophisticated and expensive pistons for carrying the moveable edge has proven unduly expensive to fabricate and does not afford the necessary angular range for application of actuating forces for practical use on a one-piece overhead garage door.

Thus, there exists a need for a deactuator which is highly sensitive to contact with an object during closure of the door such that contact with a small child or the like during closure will deactuate the closure to protect the child from injury. The design challenges for such a device are greater for one-piece overhead garage doors since those doors typically close in a manner which swings the free lower end of the door through an arcuate path. This results in contact being made by the lower edge of the door with an obstructing object from any one of a number of different directions throughout a wide range of angles depending on the height of such lower edge at the point of contact.

Prior efforts to devise satisfactory deactuation mechanisms have led to the proposal of a symmetrically shaped semi-circular hollow deflectable channel member mounted centrally on a door edge and carrying an electrical contact and which will be deflected upon impact to engage a cooperating contact to thereby generate an electrical signal. A device of this type is shown in U.S. Pat. No. 1,511,055 to Entwistle. Devices of this type, while satisfactory for their intended uses, suffer the shortcoming that substantial force is required for deflection of the channel and contact with an object at an angle of, for instance, 45° to the plane of the door, typically fails to adequately deflect the channel to make contact and close the circuit.

Other efforts to provide a satisfactorily sensitive door edge sensing mechanism has led to the proposal of pneumatic tubes or the like mounted adjacent the door edge for deformation upon contact to increase the pressure in the tube for sensing by a pressure sensitive switch. A device of this type is shown in U.S. Pat. Nos. 3,303,303 and 4,620,072 to Miller. Such devices, while sufficiently sensitive to be actuated upon engagement of the door edge with a forklift vehicle or the like, typically cannot be designed sufficiently sensitive to respond at different temperatures, under a variety of climatic conditions, and with sufficient sensitivity to fully minimize injury to a person contacted thereby.

Other solutions have been proposed which incorporate electrically conductive strips spaced apart by means of a compressible insulative strip or the like to create a pressure sensitive switch such that compression thereof permits the contacts to come into engagement with one another to thereby generate an electrical signal. Devices of this type are shown in U.S. Pat. Nos. 2,843,690, 3,133,167, 3,855,733, 4,273,974, 4,349,710, 4,396,814, 4,785,143, 4,908,483 and 4,920,243 to Miller. Devices of this general type have been marketed under the trade designation Miller Edge by Miller Edge, Concord Industrial Park, Concordville, Pa. 19331. Such devices, while satisfactory for commercial installations where cost is not of particular consideration, have limited application for use on the free edge of one-piece garage doors since such devices must be capable of mass production and economical to use.

Other efforts to produce a satisfactory device have led to the proposal of spaced apart conductive strips housed in a flexible channel mounted centrally on a door edge and designed with an internal strut work such that forces applied to the channel are intended to act through such struts to press the strips together. Devices of this type are shown in U.S. Pat. Nos. 3,118,984 to Koenig and 4,115,952 to French. The cost of such continuous strips is considerable and range of angles from which actuation forces may be applied is limited.

Devices have also been proposed which incorporate hollow tubes mounted along the edges of automatic doors for containing pressurized fluid which is responsive to application of forces for deactuating an operator. A device of this is shown in U.S. Pat. No. 4,133,365 to Schleicher. Such devices, while satisfactory for installations where the climatic conditions are constant and substantial forces are not objectionable, suffer the shortcoming that such fluid does not typically operate over wide ranges of temperature variations.

A safety edge has also been proposed which incorporates a contact strip in the form of a knife edge, apparently designed to be located centrally on the leading edge of the roller gate or the like. A device of this type is shown in U.S. Pat. No. 5,023,418 to Beckhausen. While satisfactory for use on a roller gate or the like to be advanced along a linear path, such devices fail to detect an object sufficiently far in advance of a one-piece door closing through an arc to satisfactorily avoid injury or damage.

Thus, there exists a need for an actuator apparatus for mounting on the lower edge of a one-piece garage door and configured such that application of forces thereto from various different angles as dictated by the point in the path followed by the lower edge during closure at which contact is made with an obstruction to thereby avoid application of excessive forces to the object.

SUMMARY OF THE INVENTION

The present invention is characterized by an elongated electrically conductive channel mounted from a non-conductive base and formed in cross section with a wall which is, upon contact with an obstruction, deflectable through a predetermined path. Mounted in the interior of the channel and extending throughout the length thereof is an elongated, conductive strip disposed in the path of the deflectable wall such that deflection of such wall through such path results in contact between such wall and strip to thereby complete a circuit which may be utilized to halt and/or reverse operation of the door operator.

Other objects and features of the invention will become apparent from consideration of the following description taken in connection with the accompanying drawings.

BRIEF DESCRIPTION OF THE DRAWINGS

FIG. 1 is a perspective view of a safety actuator embodying the present invention;

FIG. 2 is a broken rear view, in enlarged scale, taken along the line 2—2 of FIG. 1;

FIG. 7 is a schematic depicting the electrical circuit incorporated in the safety actuator shown in FIG. 6;

DESCRIPTION OF THE PREFERRED EMBODIMENTS

Figure 3:
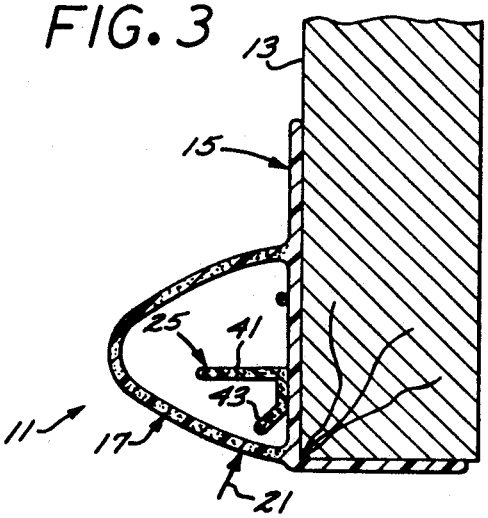
FIG. 3 is a partial vertical, sectional view, taken along the line 3—3 of FIG. 2.
Figure 4:
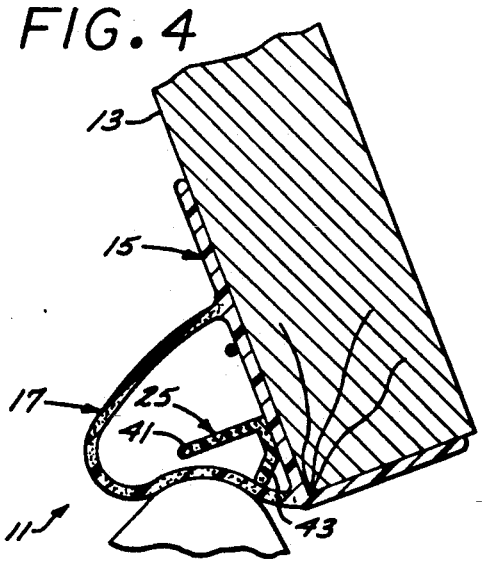
FIG. 4 is a sectional view, similar to FIG. 3, but showing the safety actuator contacting an object disposed in its path.

Referring to FIGS. 1 and 2, the safety actuator apparatus of the present invention includes, generally, an elongated sensor fitting 11 mounted on the interior lower edge of a one-piece overhead garage door 13. The sensor fitting includes an elongated L-shaped base, generally designated 15, constructed of an electrically insulative vinyl compound. Mounting on the face thereof is an elliptical in cross section hollow elongated sensor channel 17 constructed of an electrically conductive vinyl compound. The wall of the sensor channel 17 is deflectable inwardly along its length, such as along a path defined by an extension of the vector arrow 21 shown in FIG. 3. A generally J-shaped in cross section electrical strip, generally designated 25, also constructed of an electrically conductive vinyl compound, is mounted within the chamber defined by the interior of the channel 17 such that it may be engaged by the wall of such channel upon deflection inwardly along the extended path of the vector arrow 21 as shown in FIG. 4 to thus complete a circuit between the wall of such channel and the contact strip device 25.

The need for a highly sensitive tactile safety actuator has become of such great concern that various governmental agencies have considered and have, in fact, enacted legislation restricting the sale, installation or repair of automatic door operators which fail to incorporate an effective safety actuation device for sensing and controlling an operator which is normally operative to close a garage door. The problems encountered in designing a safety actuator for a one-piece overhead garage door are somewhat different from that encountered in the design of doors travelling on a linear track, such as a sectional garage door, elevator door, or various industrial doors and common carrier doors. That is, one-piece overhead garage doors are typically mounted from a suspension mechanism, such as the mechanism generally designated 31 in FIG. 1 whereby the bottom edge of the door generally lifts up and translates outwardly and upwardly upon opening and follows a reverse path upon closing. It is of recognized concern that during closure the bottom end of the door follows a somewhat arcuate path travelling downwardly and inwardly toward the door frame. Travel is initially primarily downwardly in a vertical direction concluding with travel in a direction which is primarily horizontal. Thus, the direction from which the lower edge of such door approaches an object during travel throughout its closure path varies progressively from a direction which is primarily vertical to one which is primarily horizontal. Accordingly, the safety actuator of my invention is intended to be responsive to contact with an obstructing object throughout the entire closure path, irrespective of the point in that path at which the object is engaged.

The opening and closing of such garage doors is typically compelled by an overhead garage door opener, generally designated 35 (FIG. 1) which is coupled with an arm 37, as by a screw drive or chain, such that a receiver will be responsive to actuation of a remote transmitter to thereby initiate operating and actuate a motor to drive the door to its open or closed position.

It is this path of travel during closure of the door that renders relatively fail safe operation of the sensor 11 somewhat difficult. That is, the obstructing object may be encountered at any height from just several inches off the floor to a position disposed five to seven feet above the floor or driveway. Consequently, the lower door edge may be, at the time of impact with an obstructing object, travelling through a path which has a primarily vertical component or may, as for instance, toward the completion of its closure path, have a primarily horizontal component, or during any intermediate portion of that path, a combination of horizontal and vertical components that is generally varying with the height of the lower door edge. It will be appreciated that with this construction, a generally conventional pressure sensitive contact strip arrangement mounted directly on the bottom edge of the door will be of little usefulness during that portion of the closure path when the door is travelling primarily in the vertical travel direction. Thus, the deactivating sensor device 11 is preferably mounted such that the sensor channel 17 projects from the inner face of the door at the lower margin thereof.

Electrically conductive vinyl compounds have long been known in the marketplace for various applications and one such supplier for the compound utilized in the preferred embodiment is Product No. A100-1 from Teknor Apex Company, 505 Central Avenue, Pawtucket, R.I. The compound may be extruded in a manner known to those skilled in the art such that the L-shaped base 15 (FIG. 3) of non-conductive compound may be extruded integral with the channel 17 and, if desirable, the conductive strip device 25. The extruded sensor device 11 may thus be supplied in strip form and cut to the desired length.

The cross section of the base 15 is preferably L-shaped to cap the inner lower corner of the door and embrace the lower interior margin of the door and bottom edge thereof. The channel 17 is preferably of a generally elliptical cross sectional shape to define a deflectable nose which, in response to rather minor forces, as represented by the vector arrow 21, will readily deflect inwardly.

The cross section of contact device 25 may be in the form of a single linear strip or, as shown in the preferred combination, may be somewhat in the form of the letter J to define a main leg 41 projecting perpendicular to the face of the door 13 and a minor leg 43 angling generally downwardly and outwardly approximately 45° to the face of such door. Thus deflection of the wall of the channel 17 near the base resulting from contact with an object from a somewhat oblique direction will serve to make contact with the minor leg 43 while contact of the apex thereof during initial downward travel will serve to deflect such apex to make contact with the tip end of the major leg 41.

Referring to FIGS. 1 and 2, the operator 35 incorporates a switch (not shown) operative in response to an electrical signal to deactuate the operator. The terminals of that switch are connected with the sensor channel 17 and contact device 25 by means of respective electrical cables 45 and 47. Referring to FIG. 2 in the embodiment shown for illustrative purposes, one such terminal is connected to the distal end of the sensor channel 17 by means of the lead 45 and the opposite such terminal is connected with the proximal end of the contact device 41 by means of the cable 47. It will be appreciated by those skilled in the art that the invention may be incorporated in numerous different embodiments including those having such cables both connected at the same end of such sensor device 11.

Figure 5:
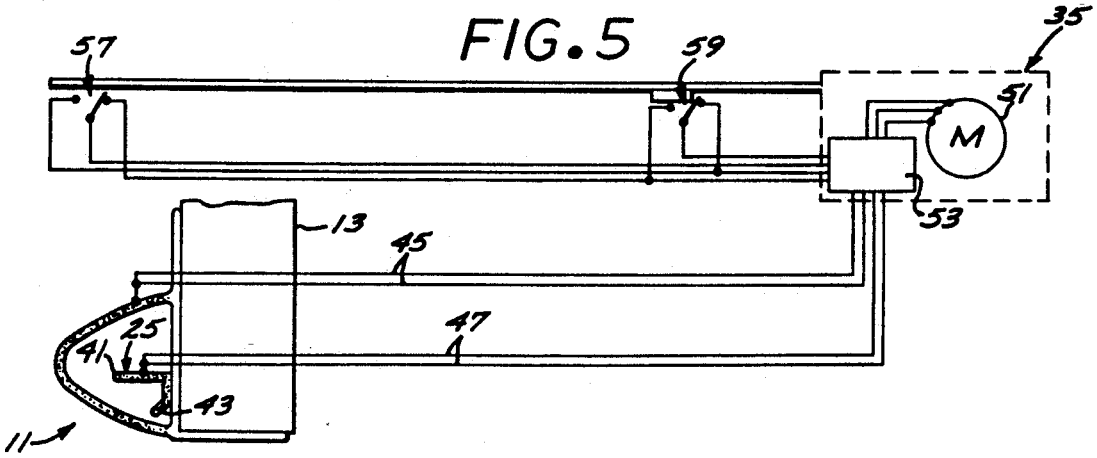
FIG. 5 is a schematic of the electrical circuit incorporated in the safety actuator shown in FIG. 2.

Referring to FIG. 5, the reversible motor 51 of the operator 35 is connected with a logic board 53 which acts as a reverse switching mechanism, the sensor device 11 and up and down limit switches, generally designated 57 and 59, respectively. In the embodiment shown, the lead cables 45 and 47 incorporate the safety feature afforded by dual leads.

In operation, the sensor device 11, cables 45 and 47, operator 35, and logic board 53 will typically be marketed packaged together and the installer may merely unpackage the components and install the operator in a conventional manner. The sensor device 11 may then be installed on the inside lower edge of the door 13 and the cable 45 threaded through the hollow interior of the channel 17 to connect the end thereof with the distal end to maintain good electrical contact. The cable 47 may then be connected with the proximal end of the sensor device 25 as shown in FIG. 2.

Then, upon operation, the door may be opened and closed in a conventional manner. However, should the sensor device 11 come into contact with an obstructing object during closure thereof, the wall of such channel 17 will be deflected inwardly, as for instance along the vector path 21, to engage either or both the contact legs 43 or 41. As shown in FIG. 4, in the event contact is made with the minor leg 43, the circuit will be closed, thus switching the logic board 53 to reverse the circuit to the motor 51 to reverse travel of the door. In practice, the flexure of the wall of the channel 17 is such that even the lightest contact with a relatively vulnerable body part, such as a child's neck, will be sufficient to deflect such wall sufficiently to short against the contact device 25, all in response to a force well within the range which will avoid injury to a child's arm, hand or neck. Thus, the sensor device of the present invention provides a effective and safe arrangement for deactuating an automatic door opener before a person disposed in the path thereof might be subjected to injury.

Figure 6:
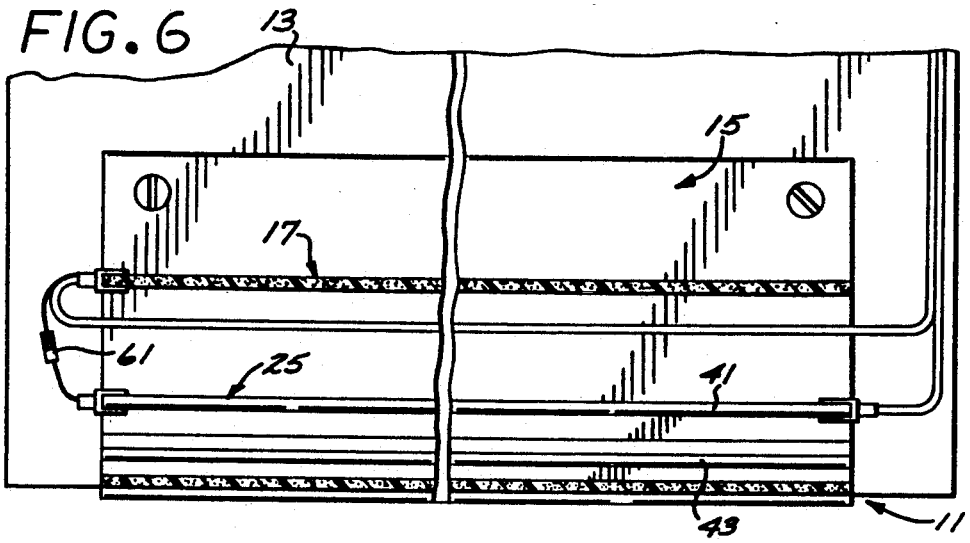
FIG. 6 is a broken rear view showing a second embodiment of the safety actuator of the present invention.

The safety actuator sensor device shown in FIGS. 6 and 7 is somewhat similar to that shown in FIGS. 2 and 5 except that a shunt resistor 61 is connected between the sensor channel 17 and contact device 25 to thereby provide a closed circuit. The remote end of the sensor channel 17 is then connected with the logic board 53 by means of a lead 65 (FIG. 7) and the contact device 25 connected therewith by means of a lead 67. Accordingly, when contact is made between the wall of the sensor channel 17 and contact device 25, a current path is set up parallel to the shunt resistor 61 to thereby provide an overall reduced resistance which will be sensed in the logic board 53 to reverse the motor 51 of the operator 35.

Figure 8:
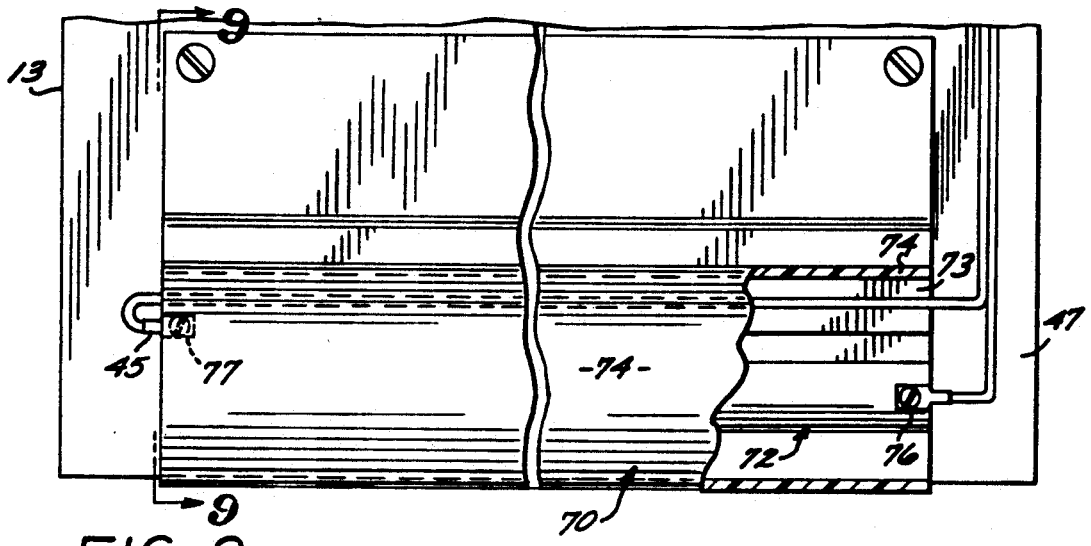
FIG. 8 is a broken rear view showing a third embodiment of the safety actuator of the present invention.
Figure 9:
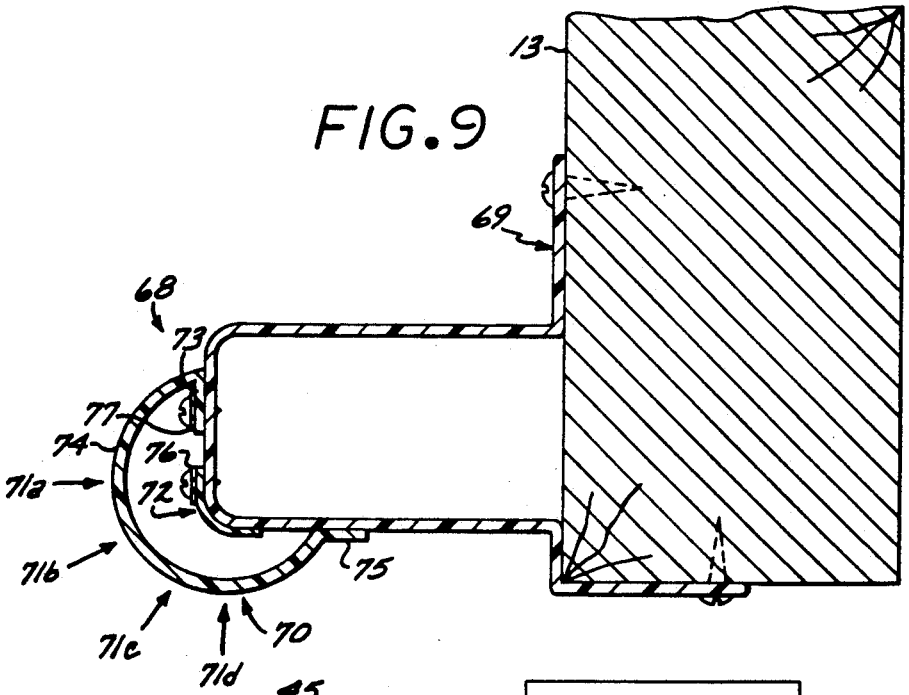
FIG. 9 is a vertical sectional view, taken along the line 9—9 of FIG. 8.

The safety actuator sensor device shown in FIGS. 8 and 9 is an alternate embodiment of the present invention. In this embodiment, the safety actuator of the present invention is mounted to the interior lower edge of a one-piece overhead garage door 13 by an elongated hollow semi-rigid mounting channel 69. The sensor channel 70 is generally C-shaped in cross section and is formed at one lateral side with an internal mounting flange 73 and at is opposite lateral side with an out turned mounting flange 75. An elongated electrically conductive sensor strip, generally designated 72, is configured to nest against the lower inner corner of the mounting channel 69. For the purpose of illustration, electrical terminals 76 and 77 are shown attached to one end of the sensor strip 72 and one end of the sensor channel 70 via screw fasteners. Alternatively, pop rivets may be employed.

The mounting channel 69 is preferably generally rectangular cross sectional shape to provide an interiorly extended support structure of approximately two inches to dispose the actuator sensor spaced inwardly from the inner surface of the door so that during door closure it will precede the lower door edge tangentially in the circumference of the arc created by the moving lower door edge. The bottom wall of the mounting channel 69 is preferably L-shaped to define a jog which caps the inner lower corner of the door and embraces the lower interior margin of the door and bottom edge thereof and serves to, when the door is closed, dispose the lowermost periphery of the sensor channel 70 at or above the level of the bottom edge of such door. The mounting channel 69 is generally rectangular in cross section and is constructed of a semi-rigid PVC or the like so as to preclude injury or damage to an obstructing object upon contact therewith.

The cross section of the wall of the sensor defines a deflectable surface 74 which, responsive to a rather minor force acting from any of a variety of angles, as represented by the vector arrows 71*a–d*, to readily deflect such wall inwardly and engage the contact strip 72.

The contact strip 72 is disposed generally in the path of the wall of contact strip channel 70 so that upon inward deflection thereof from any direction through about a 90° arc of directions represented by vectors 71*a–d*, contact will be made with such strip.

In operation, the sensor 68 may be mounted on the inner lower edge of a garage door 13. When the operator is activated to close the door, such lower edge will, as viewed in FIG. 9, be swung downwardly and to the left toward the position shown. As such edge swings downwardly, it will carry the sensor channel through an arcuate path essentially leading such lower edge through its path. With the configuration shown, it will be clear that, should any object even as small as that which would rise only one or two inches from the floor in the vicinity of the position normally occupied by the lower door edge, when closed, engagement will be made with the mounting channel 69 configured to span the contact strip 72 two inches in front of the lower front door edge. It will be apparent that, for an object as small as the diameter of a baby's arm, the wall of such sensor channel 70 will engage well ahead of the door thus causing such wall to deflect inwardly to engage such contact strip 72 to thus deactuate and reverse the door operator. The construction of FIG. 9 offers the advantage that should the door continue its downward path for a short period of time after closure of the wall of the sensor channel 70 on the contact strip 72 and generation of the stop and reverse signal, a cushioning effect is provided. That is, upon contact of the inwardly deflected wall of the sensor channel 70 with the contact strip 72, the wall of the mounting channel 69 is free to, under further force or displacement, flex inwardly toward the face of the door 13 thus minimizing the application of any greater force to the object encountered.

Figure 10:
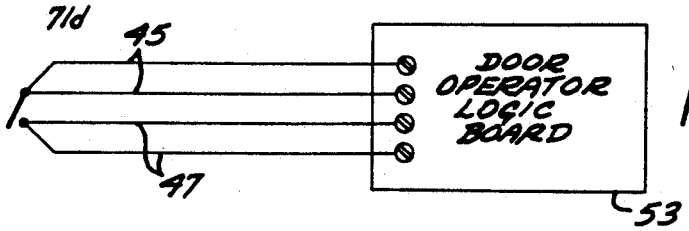
FIG. 10 is a schematic of an electrical circuit incorporated in the safety actuator shown in FIGS. 2 and 8.

The terminal lead diagram in FIG. 10 is similar to FIG. 5 except that the actuator sensor device shape is not shown in the diagram. The four-wire system (45, 47) interconnects the logic board 35 with the sensor channel 70 and contact strip 72 and allows the continuity of cables 45 and 47 to be continually monitored.

Figure 11:
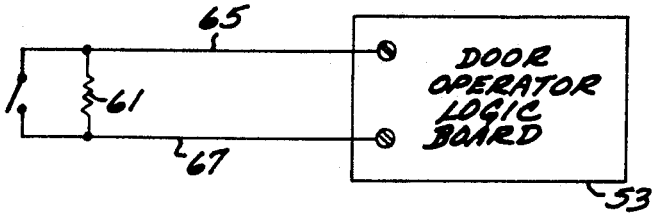
FIG. 11 is an electrical schematic showing a modification of the electrical circuit depicted in FIG. 10 and is shown in FIGS. 6 and 7.

The terminal lead diagram in FIG. 11 is similar to FIG. 7 and illustrates a two wire system. The terminal leads connect the sensor channel and contact strips 72 by means of electrical cables 65 and 67. The circuit through resistor 61 serves to continually allow the conductors' continuity to be monitored.

From the foregoing, it will be apparent that the sensor device of the present invention provides an economical and reliable means for sensing the existence of an obstructing object in the path of a one-piece overhead door during closure thereof and which is responsive thereto to reverse an automatic garage door operator.

Various modifications and changes may be made with regard to the foregoing detailed description without departing from the spirit of the invention.

What is claimed is:

1. Tactile sensor apparatus for deactivating and or reversing an automatic operator driving a one-piece overhead door upon contacting an obstructing object, comprising:

a semi-rigid elongated mounting member attached to said door along its bottom edge and configured to project away from said edge in the direction of travel during closing of said door;

a sensor channel, longitudinally attached along said mounting member, including an electrically conductive and resilient wall configured to form a hollow elongated chamber, said wall being responsive to flex inwardly upon application of a predetermined force thereto; and an electrically conductive contact strip disposed within said chamber and mounted along said mounting member whereby contact with an obstructing object will cause said predetermined force to be applied to said wall of said sensor channel to cause said wall to flex inwardly to make electrical contact with said contact strip.

2. Tactile sensor apparatus of claim 1 wherein said mounting member projects perpendicularly away from a plane defined by the height and width of said door.

3. Tactile sensor apparatus of claim 2 wherein said mounting member forms a projection substantially rectangular in cross section, and said sensor channel is substantially C-shaped in cross section, disposed so as to enclose a bottom corner of said mounting member.

4. Tactile sensor apparatus of claim 3 wherein said contact strip is curve shaped in cross section and mounted along said bottom corner.

5. Tactile sensor apparatus of claim 1 wherein said mounting member is constructed of a semi-rigid, electrically insulative vinyl compound.

6. Tactile sensor apparatus of claim 1 wherein:

said mounting member is constructed to span said contact strip at least two inches from the interior surface of said door.

7. Tactile sensor apparatus of claim 1 wherein:

said mounting member is constructed to disposed, when said door is closed, the bottom extent of said sensor channel in substantially the plane including the bottom edge of said door.

8. A garage door sensor apparatus for deactuating and or reversing an automatic one-piece garage door operator upon contacting an obstructing object comprising:

an elongated sensor strip substantially disposed in spaced relationship two inches from the lower edge of said door projecting along the lower edge of said door and responsive to engagement with said object to cause an electrical deactivating and or reversing signal to be generated; and a semi-rigid mounting channel for mounting said sensor strip in said spaced relationship to said lower edge of said door to cause said sensor strip, when said door is moved toward its closed position, to come into contact with said object to thus cause said electrical deactivating and or reversing signal to be generated at a point in time prior to the time when said lower edge of said door reaches said object.

* * * * *